United States Patent [19]

Mihara

[11] Patent Number: 4,714,374

[45] Date of Patent: Dec. 22, 1987

[54] ROAD SURFACE LAYER REPRODUCING MACHINE

[75] Inventor: Tohru Mihara, Kyoto, Japan

[73] Assignee: Taisei Road Construction Co., Ltd., Tokyo, Japan

[21] Appl. No.: 882,136

[22] Filed: Jul. 2, 1986

[30] Foreign Application Priority Data

Apr. 16, 1986 [JP] Japan ..... 61-57238[U]

[51] Int. Cl.[4] ..... E01C 23/06

[52] U.S. Cl. ..... 404/91; 404/92; 299/39

[58] Field of Search ..... 404/91, 92, 95, 77, 404/79, 124; 299/39

[56] References Cited

U.S. PATENT DOCUMENTS

| | | | |
|---|---|---|---|
| 3,055,280 | 9/1962 | Neville | 404/95 |
| 3,989,401 | 11/1976 | Moench | 404/95 |
| 4,018,540 | 4/1977 | Jackson, Sr. | 404/95 |
| 4,226,552 | 10/1980 | Moench | 404/92 |
| 4,317,642 | 3/1982 | Wirtgen | 404/91 |
| 4,319,856 | 3/1982 | Jeppson | 404/95 |
| 4,335,974 | 6/1982 | Wirtgen | 404/92 |
| 4,347,016 | 8/1982 | Sindelar | 404/95 |

FOREIGN PATENT DOCUMENTS

| | | | |
|---|---|---|---|
| 2155525 | 9/1985 | United Kingdom | 299/39 |

*Primary Examiner*—James A. Leppink
*Assistant Examiner*—Terry L. Melius
*Attorney, Agent, or Firm*—Cushman, Darby & Cushman

[57] ABSTRACT

A road surface layer reproducing machine is characterized by its rotor unit which is provided with a mixing chamber housing the rotors for scarifying and mixing the asphalt pavement in an atmosphere of a high temperature higher than the temperature of open air to facilitate such a scarifying and mixing operation of the asphalt pavement, which mixing chamber is kept at such a high temperature by the operation of heating means such as a heater and a hot air blower, and is vertically driven through power cylinders.

4 Claims, 10 Drawing Figures

ROAD SURFACE LAYER REPRODUCING MACHINE

BACKGROUND OF THE INVENTION

1. Field of the Invention

The present invention relates to a road surface layer reproducing machine, and more particularly to one provided with multi-axle type rotors for scarifying and mixing asphalt pavement surface layers, the rotors of which are arranged in a direction perpendicular to a travelling direction of a vehicle body of such a machine and kept at certain temperatures.

2. Description of the Prior Art

Hitherto, road surface layer reproducing machines are well known as a machine for repairing the surface layer of an asphalt pavement body. In the operation, such a machine follows a road heating machine provided with a heating unit for heating the asphalt pavement body, and comprises, in a lower portion of its self-propelled vehicle body, rotors for scarifying and mixing a road paved with asphalt having been heated, the rotors of which are followed by screw spreaders and screeds.

The conditions where such conventional road surface layer reproducing machines can be employed are that the damages exist only in the surface layers of the asphalt pavement. The thickness of the surface layers to which such conventional machines can generally repair is said to be 3 to 5 cm (See the outlines of the asphalt pavement, Japan Road Association.).

At the time of repairing operations of such a conventional road surface layer repairing machine, a heating unit is separated from a scarifying/mixing unit. Therefore pavement surfaces once heated are cooled down by the time the scarifying/mixing unit reaches the heated portions of the pavement. In addition, because such a scarifying/mixing unit is not provided with a heating-/heat-insulating means and has to conduct a mixing operation in an atmosphere at outdoor temperatures, the temperatures of the asphalt will drop rapidly.

The temperatures where the asphalt pavement can be scarified must be above the softening point of the asphalt contained in the pavement. It is requested that the average temperatures of the whole asphalt mixtures scarified should stay within a predetermined range at the time of rolling. According to the above-mentioned outlines of the asphalt pavement, such average temperatures are in a range of 110° to 140 ° C.

If the depths of the pavement to which a scarifying operation is performed are below the softening point in temperature, the aggregates contained in the asphalt mixture are apt to be broken so that the surfaces of the aggregates to which no asphalt is coated are exposed. As a result the compaction effect of the asphalt mixture is impaired to a large extent.

In view of the requirements that the depths of the pavement to be scarified should be above the softening point in temperature and that the average temperatures of the whole scarified asphalt mixtures should be within the predetermined range immediately before start of rolling, conventional machines which are not provided with heating/heat-insulating means can scarify the pavement only to half the depths of the entire surface layers to be scarified. Consequently it is very difficult to reproduce the pavement which has been impaired to the entire depths of the pavement.

The mixing units of conventional road surface layer reproducing machines are provided with a one-axle type rotor which makes it difficult to conduct a uniform mixing operation of the asphalt mixtures. Particularly, in case such a mixing and heat-insulating operation is conducted with addition of various reproducing additives and fresh asphalt mixture by such conventional machines, there is an inclination to lack uniformity in the mixtures. Some conventional machines are equipped with a two-axle rotor which is arranged in parallel with the advancing direction of the vehicle to eliminate the lack of uniformity in the mixtures. But these machines lack a heating and heat-insulating means for the scarified surfaces which are exposed to atmosphere temperatures, resulting in a drop of the temperatures of the scarified surfaces. No such machines can improve the quality of the reproduced asphalt mixtures.

SUMMARY OF THE INVENTION

It is an object of the present invention to provide a road surface layer reproducing machine which makes it possible to solve the problems inherent in the conventional machines, to select scarified depths over the entire thickness of the surface layers of the asphalt pavement, to remove lack of uniformity in mixing of the asphalt mixture, and to keep an average temperature of the entire asphalt mixture to be reproduced at temperatures above a predetermined level.

When dense graded asphalt concrete is heated continuously for 6 minutes at 61,000 kcal/hr/m$^2$ by means of an infrared radiation heater employing liquefied petroleum gas (LPG) as a fuel, it is found that the temperatures of such dense graded asphalt concrete vary in accordance with the depths thereof as shown in FIG. 10.

In case a pavement layer in a certain depth is rapidly heated up to a temperature above its softening point, the surface temperature often rises above the ignition point. The most effective heating method is to raise the temperatures of the inner layers of the pavement by heating intermittently to keep the surface temperature below the ignition point. This can be realized by operating a heating unit in conformity with the capacity, heating intervals and working speeds of the heating unit.

In case the road surface heating machine equipped with such a heating unit having the above construction leads, a road surface layer reproducing machine will follow the same. Such a road surface layer reproducing machine has a following structure:

The road surface layer reproducing machine comprises; in a lower portion of a vehicle body thereof, a rotor unit for scarifying/mixing an asphalt pavement, spreaders and screeds, and wherein the improvement resides in:

said rotor unit provided with a mixing chamber defined by a supporting frame which is vertically movable through power cylinders and is provided with: an opening in its lower section; a heating room in its upper section; and a plurality of rotors arranged in a direction perpendicular to an advancing direction of the vehicle body in rows so as to be rotated in a direction opposite to that of adjacent one; the heating room is equipped with a heating means for heating an internal atmosphere to high temperatures above that of the open air and keeping the internal atmosphere at the high temperatures.

It is preferable that the rotor unit is provided with a front rotor and a rear rotor, while conical bits are provided in the front rotor and flat bits are provided in the rear rotor.

Further, it is preferable that the heating means is provided with a heat-insulating plate provided in the upper section of the mixing chamber so as to define the heating room in which gas burners are equipped to make it possible to supply hot air.

In the road surface layer reproducing machine of the present invention, since the supporting frame is shaped into a cage-like form having an opening in its lower portion and is provided with the heating means, it is possible to heat and keep the internal atmosphere in the supporting frame to temperatures higher than those of the open air, for example, to high temperatures of 120° to 300 ° C. Therefore, the supporting frame serves as a heat-insulating chamber for preventing the blocks of the road surface layers thus scarified from being cooled by the open air.

Since the rotors in the supporting frame are heated, heat is transmitted from the rotors to the blocks of the road surface layers through heat exchange during the rotation of the rotors so as to heat the blocks of the road surface layers. Since the rotors are arranged in parallel with each other in rows, it is possible to conduct uniform kneading of the asphalt mixtures.

DESCRIPTION OF THE PREFERRED EMBODIMENTS

Figure 1:
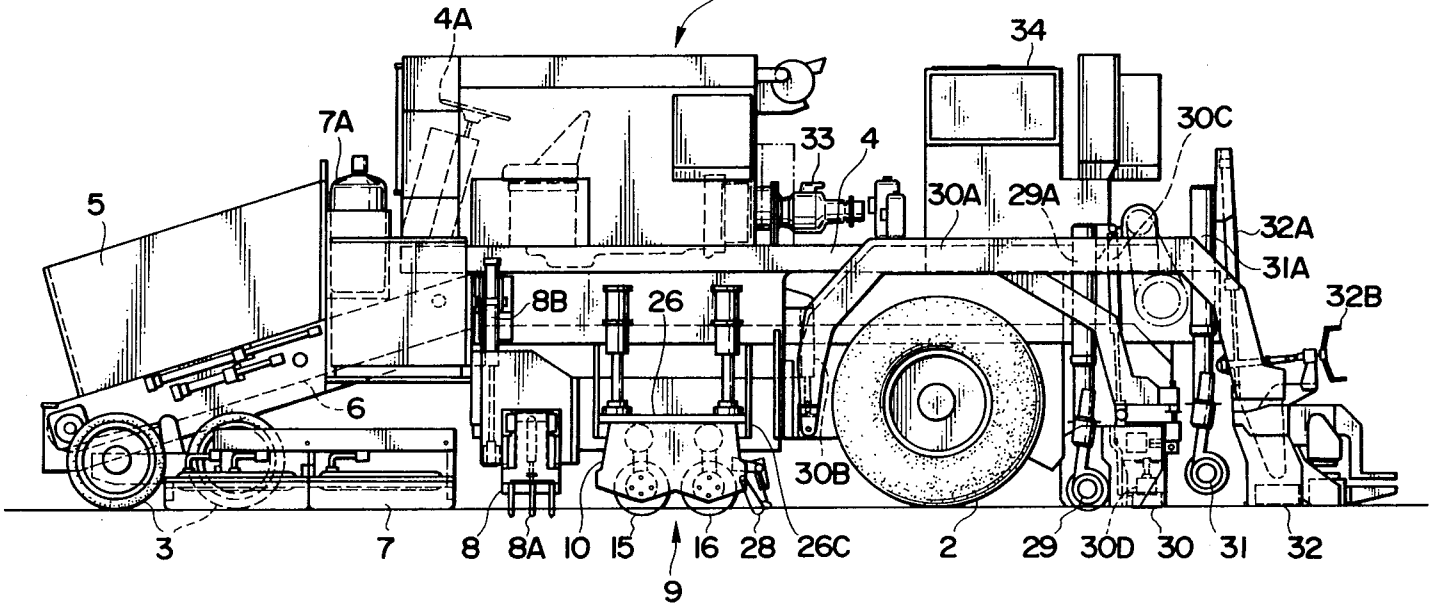
FIG. 1 is a side view of a road surface layer reproducing machine of the present invention.

A preferred embodiment according to the present invention will be described with reference to the drawings. FIG. 1 is a side view of the road surface layer reproducing machine, in which view the left part is the front of the machine.

The road surface layer reproducing machine 1 of the present invention is a self-propelled vehicle provided with drive wheels 2 and small-sized two-axle front wheels 3 which are controlled by a steering wheel 4A.

A front portion of a vehicle body of the road surface layer reproducing machine has a low slanted construction on which a hopper 5 is equipped. Extending from the lower portion of the hopper 5 to the rear portion of the body 4, a bar feeder 6 is slidably mounted to transfer paving materials, which are contained in the hopper 5, to the front of a second screed 32 mounted on the rear portion of the body.

In a lower portion of the vehicle body 4, there are provided between the front wheels 3 and the drive wheels 2, from front to rear, a heater 7, a scarifier 8 and a rotor unit 9.

The heater 7 is a combination type of far infrared radiation unit and gas burners for heating the asphalt pavement body (surface layers) when the pavement body is repaired, i. e., reproduced. The heating temperatures are variable according to the atmospheric temperatures and asphalt temperatures. The reference numeral 7A denotes a gas cylinder for feeding a fuel gas to the gas burners.

The scarifier 8 is provided with a plurality of claws 8A in a projecting manner. The claws 8A are arranged in the advancing direction of the vehicle body 4 in a staggered manner to form a set of three staggered claws 8A a plurality of which are arranged at intervals of a predetermined distance laterally, i.e., in a direction perpendicular to the advancing direction of the vehicle body 4, to make it possible to penetrate into the road surface layers and to be vertically movable through a power cylinder 8B. It is possible to scarify the pavement surface layers by driving the vehicle body 4 while the claws 8A are penetrating into the pavement body.

The machine of the present invention does not always require the scarifier, because the rotor unit of the same machine can scarify to a sufficient extent.

Figure 2:
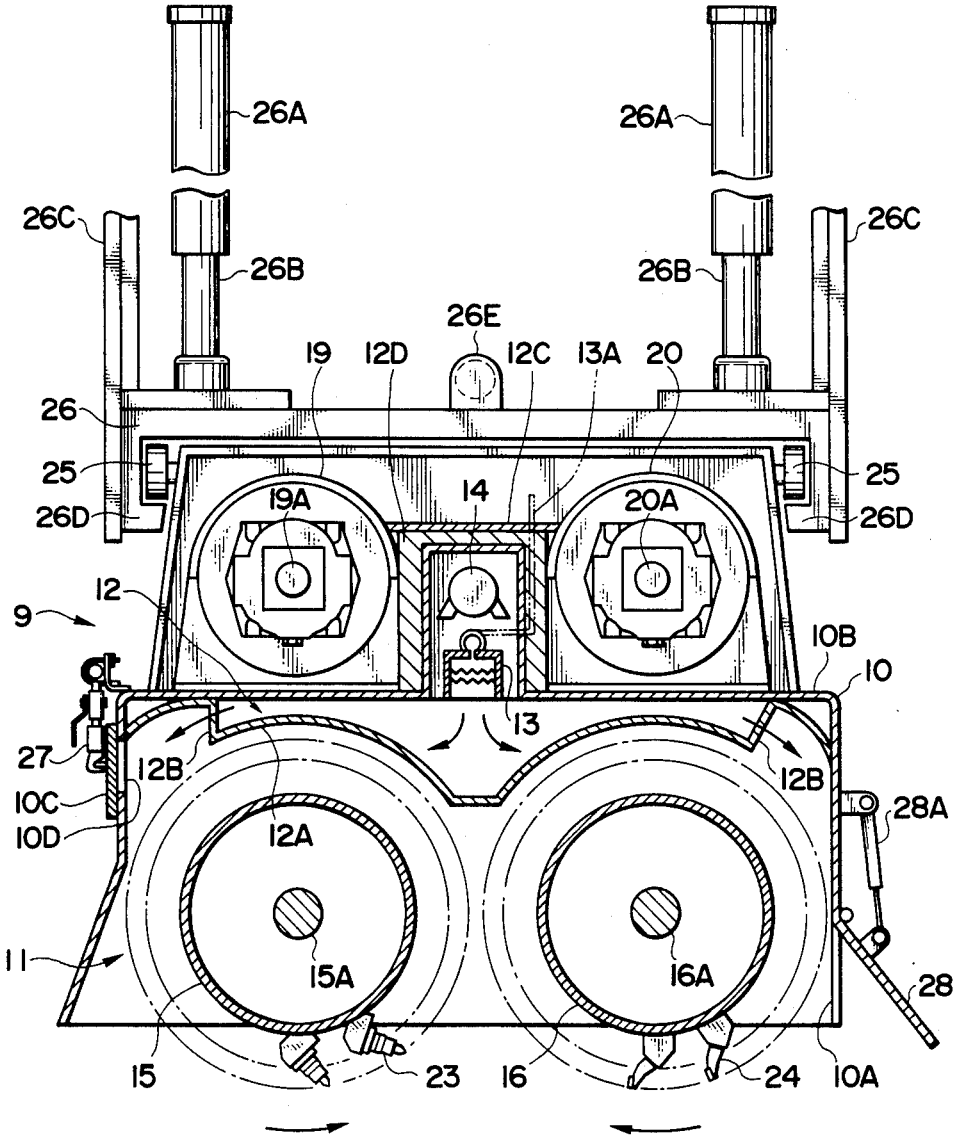
FIG. 2 is a side view of a rotor unit of the road surface layer reproducing machine.
Figure 3:
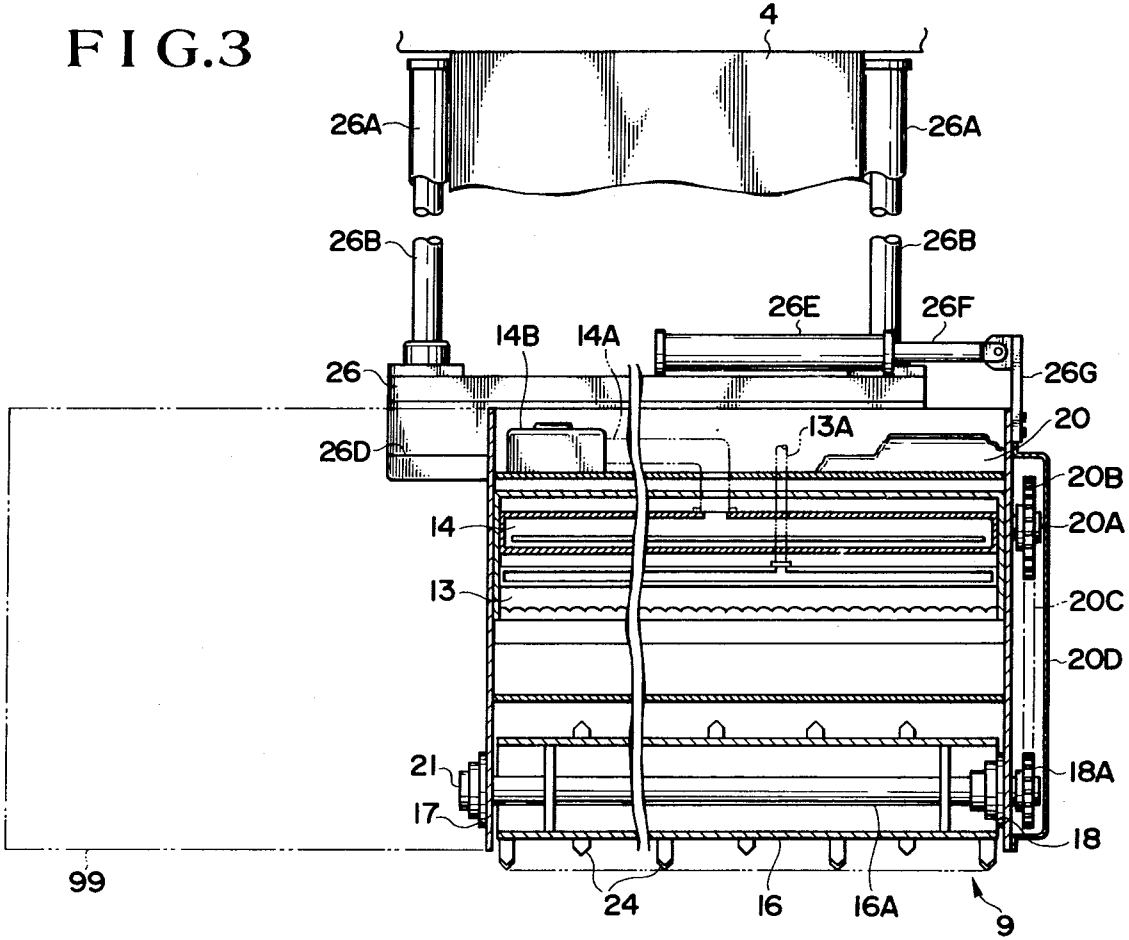
FIG. 3 is a longitudinal sectional front view of the rotor unit.

As shown in FIGS. 2 and 3, the rotor unit 9 is shaped into a cage-like form defined by a supporting frame 10 provided with an opening 10A in its lower section. The supporting frame 10 is provided with a middle ceiling 10B in an expanding manner inside the same to define a mixing chamber 11 in its lower portion. In an upper section of the mixing chamber 11 is defined a heating room 12 with a help of a heat-insulating plate 12A which takes an arcuate form in its side view as shown in FIG. 2 to make it possible for the plate to be brought into slidable contact with the asphalt mixture taken up by the rotation of the rotors of the rotor unit 9 in the upper portions of the rotors, and is provided with vent holes 12B both in front and rear ends of the heat-insulating plate.

In an upper portion of the heating room 12, there is provided a projecting portion 12C which projects upward from the middle ceiling 10B, extends in a direction perpendicular to the advancing direction of the vehicle body 4, and has a double-walled construction in which an inner wall is constructed of a heat-resistant material made of aluminum plates and a hollow portion between the walls is packed with a heat insulator 12D. Below the projecting portion 12C is provided a heater 13 constructed of gas burners, the flames of which are directed downward. A pipe 13A of the heater 13 is connected to a gas cylinder 7A through a hose (not shown). In an upper portion of the heater 13, there is provided a blower nozzle 14 in a longitudinal direction of the heater 13, the blower nozzle 14 is connected through a duct 14A to a blower 14B provided in an upper portion of the middle ceiling 10B.

In the mixing chamber 11 are provided a plurality of rotors 15, 16 (of two units in the embodiment shown in the drawings) which are arranged in parallel with each other in a direction perpendicular to the advancing direction of the vehicle body 4.

The rotors 15 and 16 have their axles 15A and 16A, respectively. Both ends of each of the axles 15A and 16A extend outward from the supporting frame 10 and are supported by bearings 17 and 18, while one of these ends is provided with a sprocket 18A. Above the rotors 15 and 16 and in an upper portion of the middle ceiling 10B, there are provided hydraulic motors 19 and 20, output shafts 19A and 20A of which are provided with sprockets 20B. A chain 20C runs around the sprockets 18A and 20B. In the drawings, the reference numeral 20D denotes a chain cover.

Figure 4:
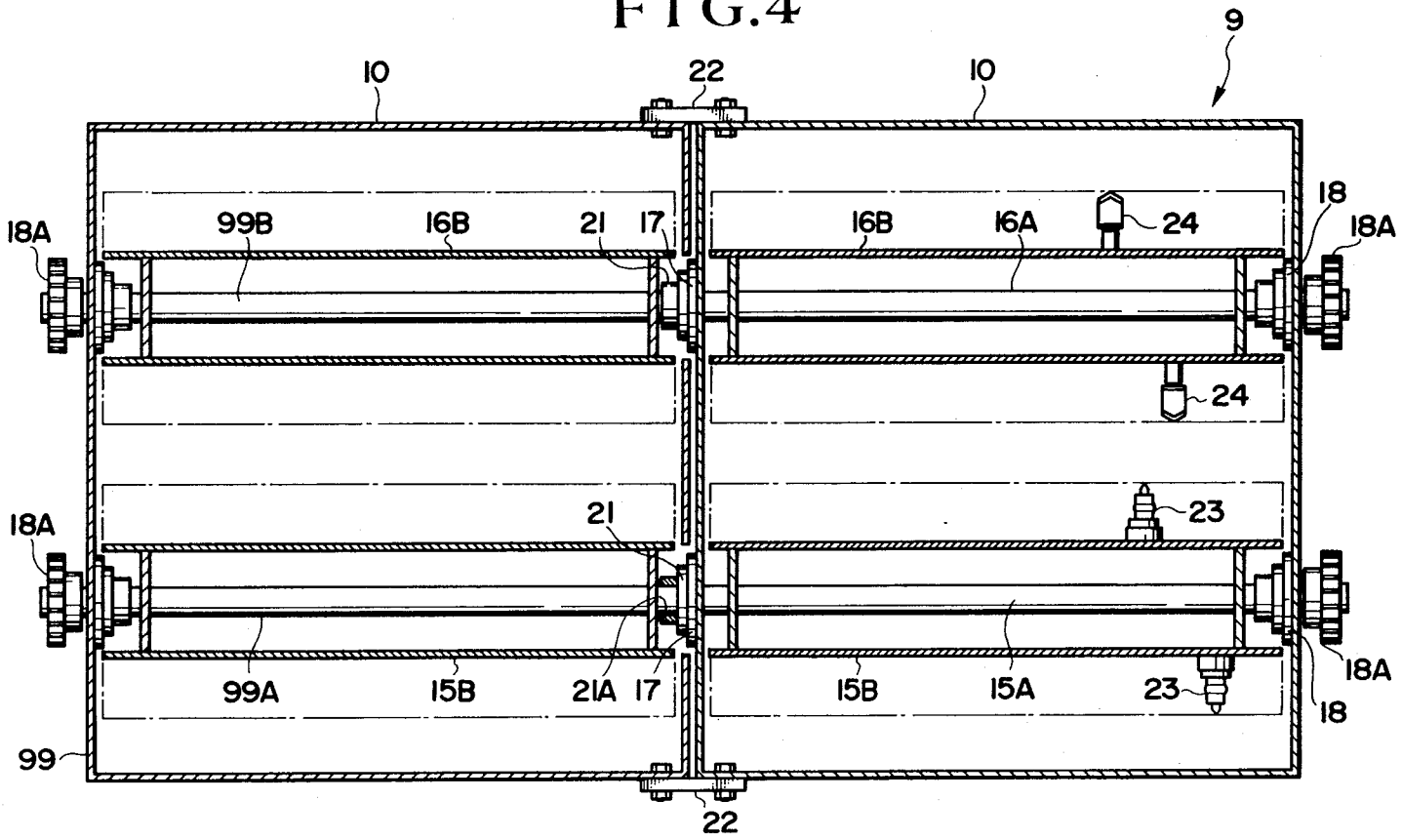
FIG. 4 is a plan view of a rotor portion of the rotor unit.

Couplers 21 are fixed to the other ends (which extend outwards from each bearing 7) of the axles 15A, 16A of the rotors 15, 16, i. e., to the leftward ends of the axles 15A and 16A as shown in leftward portions of FIGS. 3 and 4. The coupler 21 is provided with a coupling hole in its end face so as to receive an axle of a rotor for width-widening use. FIG. 4 shows a condition in which such a rotor unit 99 for width-widening use is connected to the rotor unit 9 of the road surface layer reproducing machine of the present invention.

The rotor unit 99 for width-widening use has the same construction as that of the rotor unit 9, so that its parts are denoted by the same reference numerals as those employed in the above description of the rotor unit 9. The rotor unit 99 is connected to the rotor unit 9 by connecting axles 99A and 99B to the couplers 21 and the supporting frames 10 are connected to each other through coupling plates 22 in a fixing manner. The rotor unit 99 for width-widening use is employed as an auxiliary unit for the rotor unit 9.

Figure 5:
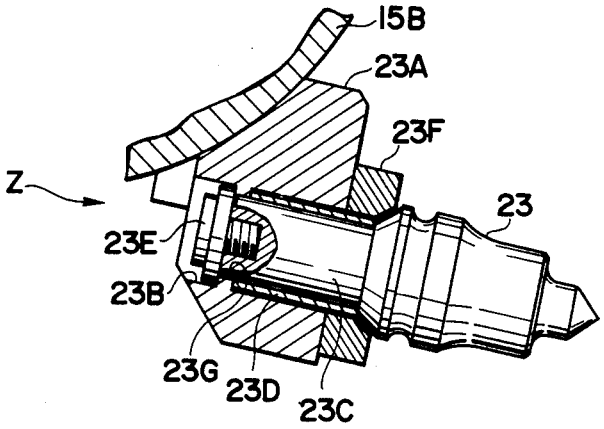
FIG. 5 is a side view of a conical bit provided in a front rotor of the rotor unit.
Figure 6:
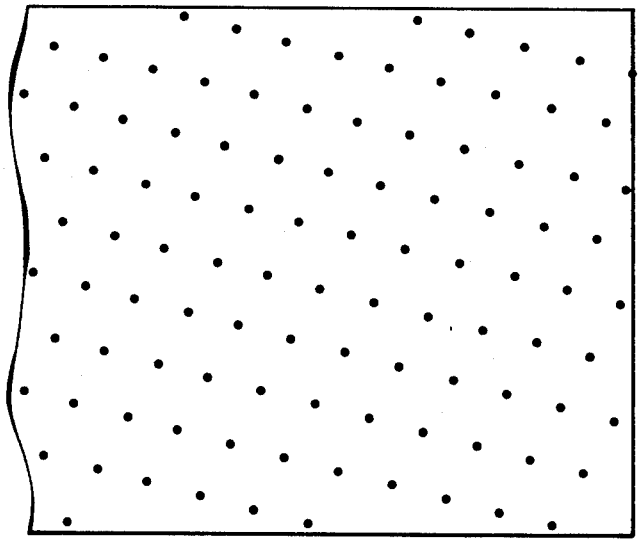
FIG. 6 is a circumferential development view of the front rotor.

As shown in FIG. 5, on a circumferential surface of each of drums 15B of a front rotor 15 of rotors 15 and 16 of the rotor units 9 and 99, there are provided a plurality of conical bits 23 so as to be directed in a direction indicated by arrow Z, i.e., in a rotational direction of the drum 15B. FIG. 6 is a development view of the circumferential surfaces of the drum 15B. As shown in FIG. 6, on the circumferential surfaces of the drum 15B, the conical bits 23 are so arranged in an interspersing manner that the pavement surface layers are continuously scarified as shown in thin longitudinal lines when the drum 15B is rotated.

As shown in FIG. 5, the fixing mount 23A of the conical bit 23 stated above is fixed to the circumferential surfaces of the drum 15B by welding. A shaft portion 23C is inserted into a fitting hole 23B in the fixing mount 23A with a cylindrical spring 23D around the shaft portion 23C. A stopper 23E is threadably fixed to the base end face of the shaft portion 23C. In the drawings: the reference numeral 23F denotes a mount base; and 23G denotes an annular stopper formed on inner circumferential surfaces of the fitting hole 23B in a projecting manner. The above construction allows a swinging operation of the conical bit 23. A mount base 23F worn out can be replaced with a new one.

Figure 8:
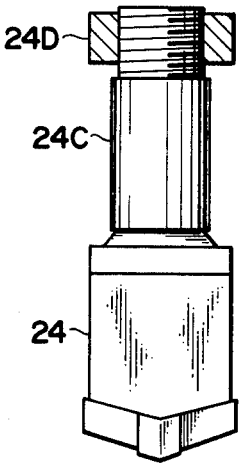
FIG. 8 is a front view of the flat bit.
Figure 7:
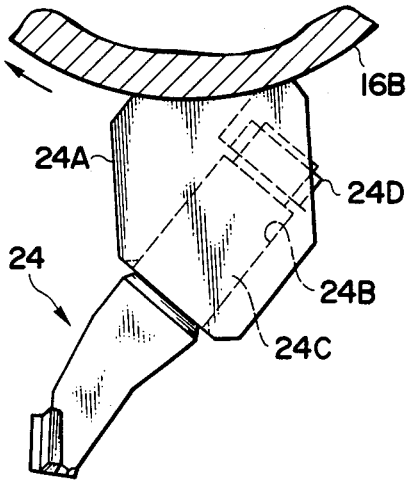
FIG. 7 is a side view of a flat bit provided in a rear rotor of the rotor unit.
Figure 9:
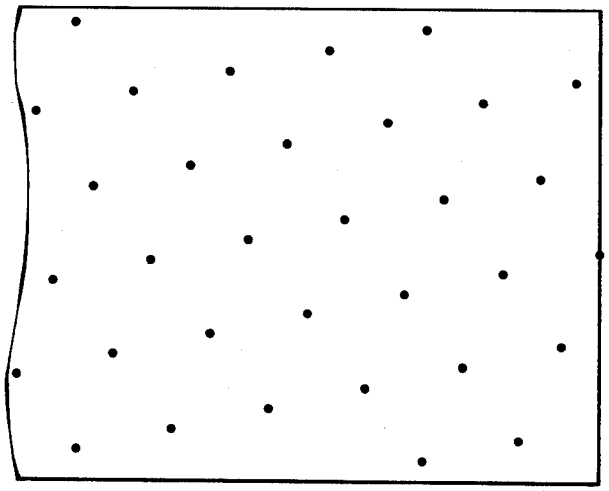
FIG. 9 is a circumferential development view of the rear rotor.
Figure 10:
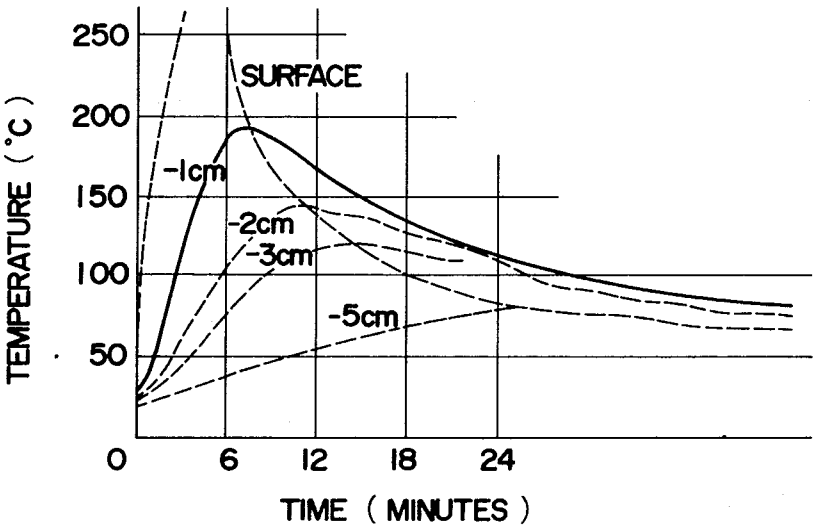
FIG. 10 is a graph showing heating time and temperature variations of the asphalt pavement body.

As shown in FIGS. 7 and 8, on circumferential surfaces of a drum 16B of the rear rotor 16, there are provided a plurality of flat bits 24 at the positions shown by black spots in FIG. 9 which shows a circumferential development view of the drum 16B. The rear rotor 16 is rotated in a direction opposite to that of the front rotor 15, so that a tip end of the flat bit 24 is directed in a direction opposite to that of the conical bit 23. In FIG. 7; the reference numeral 24A denotes a fixing mount; 24B a fitting hole; 24C a shaft portion; and 24D a nut.

As shown in FIG. 8, the flat bit 24 is so wide that the amount of the asphalt mixtures raked up is large. Although the wide surface of the flat bit 24 is fixed so as to be faced to the rotational direction of the drum 16B, it is also possible to arrange the surface of the flat bit 24 slantly to the rotational direction of the drum 16B, so that the pavement materials raked up can be transferred to the transverse direction like a screw conveyor.

Because the rotor unit 9 is assembled as a unit as stated above, the rotor unit 9 can be extended in width by means of an addition of another rotor as shown in FIG. 4.

As shown in FIGS. 2 and 3, in an upper front and rear portions of the supporting frame 10 of the rotor unit 9, there are horizontally provided suspension element 25 in a direction perpendicular to the advancing direction of the vehicle body 4.

On the other hand, in the middle lower portion of the vehicle body 4, an elevating frame 26 is provided so as to be suspended from the vehicle body 4 through power cylinders 26A. The elevating frame 26 is guided with a front and a rear elevating guides 26C which are suspended from the vehicle body 4, so that the elevating frame 26 is moved up and down as the piston rods 26B of the power cylinders 26A are moved in and out. In the front and rear lower portions of the elevating frame 26, guide rails 26D having L-shaped cross sections are provided. The suspension elements 25 of the rotor unit 9 are suspended from the guide rails 26D to make it possible to slidably guide the suspension elements 25 laterally relative to the vehicle body 4. In an upper portion of the elevating frame 26 is provided a power cylinder 26E a piston rod 26F of which is laterally and outwardly directed (rightward in FIG. 3). A foremost end portion of the piston rod 26F is pivotally connected to a bracket portion 26G mounted on the upper portion of the supporting frame 10, to make it possible that the rotor unit 9 is laterally moved along the guide rails 26D through an actuation of the power cylinder 26E.

Namely, in FIG. 3, when the rotor unit 9 is moved rightward from a width center of the elevating frame 26, it is possible to suspend a right half of the rotor unit 99 for width-widening use positioned on the left side in FIG. 4 from the elevating frame 26 to make it possible that the width of the rotor unit 9 is doubled. Of course, it is also possible to project the rotor unit 99 entirely laterally from the vehicle body 4 while the rotor unit 9 is positioned entirely under the vehicle body 4.

The elevating frame 26 adjusts penetrating depths of the bits 23 and 24 of the rotor unit 9 into the pavement body, while the elevating frame 26 lifts the rotor unit 9 from the road surface to be carried by the vehicle body 4 when the rotor unit is out of service.

In FIG. 2, the reference numeral 27 denotes an additive injection nozzle. In the operation an opening/closing lid plate 10C is opened and through a window hole 10D the additives, for example, asphalt softeners, stabilizing agents and other necessary additives are injected into the mixing chamber 11.

In a rear portion of the supporting frame 10 is provided a hood 28 which prevents the blocks of the scarified pavement surface layers from running off and evens the surface of the scarified pavement materials. As shown in FIG. 2, the hood 28 is constructed of a flat plate which is substantially perpendicular and pivotally connected in its upper portion to the supporting frame 10 while pivotally connected in its lower back portion to a lower end portion of the piston rod of a power cylinder 28A which is pivotally mounted on the supporting frame 10, to make it possible that the lower portion of the hood 28 is swingably moved up and down through the actuation of the power cylinder 28A.

In a rear portion of the vehicle body 4 behind the drive wheels 2 thereof, there are provided in a front-to-rear sequence: a first screw spreader 29; a first screed 30; a second screw spreader 31; and a second screed 32.

The first screw spreader 29 is constructed of two screw spreader units which are provided in each side of the vehicle body 4 and arranged in series in a direction perpendicular to the advancing direction of the vehicle body 4 so as to be driven at their outer ends, to make it possible that these two screw spreader units are lifted at their inner ends in a central portion relative to the width of the vehicle body 4 while lowered at their outer ends in each side relative to the width of the vehicle body 4, whereby the lower surfaces of the spreader units are placed in a level below the road surface. The first screw spreader 29 is lifted by a power cylinder 29A when it is out of service. In the operation, the blocks of the asphalt pavement surface layers having been scarified by the scarifier 8 are further scarified and screeded by the rotor unit 9. Onto the road surface layers thus screeded are fed the pavement materials through a bar feeder 6. The pavement materials drop on the road surface layers and are temporarily screeded in a certain width so as to be more deposited in a central portion in width of the road.

The first screed 30 is fixed to a rear portion of an arm 30A having a substantially inverted U-shaped form in its side view as shown in FIG. 1. The arm 30A, the front end of which is fixed to the vehicle body 4 via a power cylinder 30B, is mounted on the vehicle body 4 in a manner that the arm 30A straddles the drive wheel 2. On the other hand, a rear portion of the arm 30A is also mounted on the vehicle body 4 through a power cylinder 31A to make it possible that the height of the arm 30A is changeable through the actuations of the power cylinders 30B and 30C.

The first screed 30 is equipped with a heater 30D inside the same. The heater 30D can heat the entire first screed 30 which is further equipped with wideners (not shown) in its opposite side portions, which wideners can perform in-and-out movements of the wideners relative to the vehicle body 4 in a direction perpendicular to the advancing direction of the vehicle body 4 as described in Japanese Utility Model Application No. 56-7811.

The first screed 30 performs a primary compaction of the pavement body.

The second screw spreader 31 has the same construction as that of the first screw spreader 29 except that a setting level of the second screw spreader 31 is higher than the road surface level. The level setting is adjusted through the actuation of the power cylinder 31A.

The second screed 32 is a conventional means equipped in a conventional manner. The reference numeral 32A denotes a power cylinder for adjusting the height of the second screed 32 and the reference numeral 32B denotes an adjusting handle.

In FIG. 1: the reference numeral 33 denotes a pump for feeding a pressurized fluid to each of the power cylinders and drive motors; and 34 denotes a control panel for controlling each of the units.

In the operation, the road surface layer reproducing machine 1 of the present invention works as follows:

A description will be made as to a partial surface layer reproducing work for the case where cracks, exfoliations and the like defects are produced in the surface layer of the asphalt pavement.

On a work site, the hopper 5 is filled with the asphalt mixture and the road surface layer is heated by the heater 7. In the operation, it is necessary to heat the asphalt materials to the softening temperature into the depth of 5 cm below the road surface, so that a far infrared heater is employed as a heater to make it possible for the heat to penetrate the asphalt materials deep below the road surfaces. Since it takes a certain time to transmit the heat through the pavement materials, it is possible to heat the pavement materials beforehand by means of another road heating machine for a predetermined period of time prior to the scarification with the scarifier 8. The time is determined through calculations on the basis of a scarifying depth of the pavement materials, heat conductivities of the pavement materials and the temperature of the open air. In this case, the heater 7 is employed to keep the temperatures of the heated pavement materials from drop.

The vehicle body 4 is advanced by driving the drive wheels 2 at a time when the pavement materials are sufficiently heated, while the scarifier 8 and the bits 23 and 24 of the rotor unit 9 are lowered to penetrate into the pavement materials to a certain depth below the road surface. For example, when the claws 8A of the scarifier 8 are lowered to penetrate into the pavement materials by a depth of 5 cm below the road surface, it is possible to scarify the pavement surface layers to the depth of 5 cm below the road surface.

In case the conical bits 23 of the front rotor 15 of the rotor unit 9 are set so as to be lowered to penetrate into the pavement surface layers by the depth of 5 cm below the road surface while the flat bits 24 of the rear rotor 16 are set so as to be lowered to penetrate into the pavement surface layers by the depth of 4 cm below the road surface, it is possible to crash and mix the road surface layer materials having been scarified by the scarifier 8 by the use of the front rotor 15 and further to mix and sufficiently knead the road surface layer materials by means of the flat bits 24 of the rear rotor 16.

When the heating room 12 is heated beforehand by the heater 13 and hot air is fed from the blower nozzle 14 into the heating room 12 to heat the atmosphere inside the same to temperatures of 120° to 350 ° C., it is possible to heat the heat-insulating plate 12A and to keep the atmosphere inside the mixing chamber 11 at a temperature remarkably higher than that of the open air so that the rotors 15 and 16 are also kept at a high temperature.

Consequently, it is possible to scarify and knead the asphalt pavement surface layer materials by the use of the rotors 15 and 16 in the mixing chamber 11 so that the blocks of the pavement surface layer materials are heated by the high-temperature atmosphere of the mixing chamber 11, the heated rotors 15 and 16 and the heat-exchanging effect when slide-contacted with the heat-insulating plate 12 to make it possible that the asphalt pavement surface layer materials are sufficiently kneaded. In this case, the asphalt pavement surface layer materials are further heated in the mixing chamber 11 so as to increase its temperature by an amount of 10° to 30° C.

In the above mixing operation of the asphalt pavement surface layer materials it is possible to improve in quality the asphalt mixture by adequately injecting suitable additives from the injection nozzle 27 into the mixing chamber 11.

According to the advance of the vehicle body 4, new pavement materials (in this case, asphalt compounds) received in the hopper 5 are transferred rearward through the bar feeder 6 and drops onto the pavement before the second screw spreader 31 which evens the new pavement materials thus fed at a certain level, and thereafter, the succeeding second screed 32 screeds the pavement materials.

The first screw spreader 29 and the first screed 30 perform screeding and compacting of the pavement materials in a level below the road surface, while the second screw spreader 31 and the second screed 32 perform a finish screeding and compacting of the pavement materials.

As a result, it is possible to reproduce the pavement having been damaged by cracks, exfolitations and the like defects over its thickness of 5 cm below the road surface.

The present invention is not limited only to the above construction. Namely, though in the above construction, two units of the rotors 15 and 16 are employed, it is also possible to employ three, four or more units of the rotors 15 and 16 in the road surface layer reproduction machine of the present invention. It is also possible to employ other configurations of the rotors 15 and 16 and other rotational directions and speeds thereof.

It is possible to replace the rotor unit 9 with other unit, for example such as a rotor unit having a large width by disconnecting the piston rod 26F and the bracket portion 26G. Further, it is also possible to replace the rotors 15 and 16 themselves by other suitably shaped rotors.

The motors are not limited only to the hydraulic type, and any electric heating system can be employed in the heater.

The road surface layer reproducing machine 1 of the present invention has the following remarkable effects:

(A) Since the rotor unit 9 is provided with a plurality of rotors 15 and 16, it is possible to uniformly scarify, knead and even the pavement materials;

(B) Since the rotor unit 9 is equipped with the heating means, it is possible to heat the pavement materials thus scarified to high temperatures above the softening point of the same and maintain the high temperatures although the atmospheric temperatures are low, so that a sufficient softness of the asphalt material is kept to make it possible to uniformly knead and even the asphalt materials; and (C) It is possible to reproduce the asphalt pavement to a desired depth of the same on the spot.

What is claimed is:

1. A rotor unit for a road surface layer reproducing machine for scarifying/mixing asphalt pavement comprising:

a support frame, said support frame including a mixing chamber in a lower section thereof, said mixing chamber having an opening at a lowermost end thereof, said support frame further including a heating room in an upper portion thereof, said heating room including heating means for heating said mixing chamber to and maintaining said mixing chamber at a temperature which is greater than the ambient temperature;

a plurality of power cylinder means operatively coupling said support frame member to a lower portion of a vehicle body of the road surface layer reproducing machine; and a plurality of rotor means mounted to said support frame so as to be disposed in said mixing chamber such that a longitudinal axis of each said rotor means extends perpendicularly to a direction of movement of the vehicle body, the longitudinal axis of each said rotor means being disposed substantially parallel to one another such that said rotor means are mounted in rows, each said rotor means being adapted to rotate about its respective longitudinal axis such that each rotor means rotates in a direction opposite to a next adjacent rotor means.

2. The rotor unit as in claim 1, wherein said rotor means includes a front rotor and a rear rotor, said front rotor including a plurality of conical bits extending radially from a circumferential surface thereof and said rear rotor includes a plurality of flat bits extending radially from a circumferential surface thereof.

3. The rotor unit as in claim 1, wherein said heating means further includes a heat insulating plate mounted in an upper section of said mixing chamber so as to define said heating room in said support frame, gas burners mounted in said heating room, and blower means for delivering hot air from said heating room into said mixing chamber.

4. The rotor unit as in claim 2, wherein said heating means further includes a heat insulating plate mounted in an upper section of said mixing chamber so as to define said heating room in said support frame, gas burners mounted in said heating room, and blower means for delivering hot air from said heating room into said mixing chamber.

* * * * *